US009076577B2

(12) United States Patent
Roth et al.

(10) Patent No.: US 9,076,577 B2
(45) Date of Patent: Jul. 7, 2015

(54) RESISTOR ARRANGEMENT AND METHOD OF USE

(75) Inventors: Alan Roth, Leander, TX (US); Alexander Kalnitsky, San Francisco, CA (US); Chien-Chung Tseng, Zhubei (TW)

(73) Assignee: TAIWAN SEMICONDUCTOR MANUFACTURING COMPANY, LTD. (TW)

( * ) Notice: Subject to any disclaimer, the term of this patent is extended or adjusted under 35 U.S.C. 154(b) by 208 days.

(21) Appl. No.: 13/619,225

(22) Filed: Sep. 14, 2012

(65) Prior Publication Data

US 2013/0307663 A1 Nov. 21, 2013

Related U.S. Application Data

(60) Provisional application No. 61/649,119, filed on May 18, 2012.

(51) Int. Cl.

| | |
|---|---|
| ***H01C 7/10*** | (2006.01) |
| ***H01C 7/13*** | (2006.01) |
| ***H01C 13/02*** | (2006.01) |
| ***H01C 1/16*** | (2006.01) |

(52) U.S. Cl.

CPC . *H01C 13/02* (2013.01); *H01C 1/16* (2013.01)

(58) Field of Classification Search

CPC ..... H01C 13/03; H01C 1/16; H01C 1/14; H01C 3/16; G01D 5/147; G01D 5/24438; G01P 1/00; G01P 21/02; G01P 3/488; H05G 1/08; H05G 1/54

USPC ..... 338/22 SD

See application file for complete search history.

(56) References Cited

U.S. PATENT DOCUMENTS

| | | | | |
|---|---|---|---|---|
| 5,170,146 | A * | 12/1992 | Gardner et al. | 338/313 |
| 5,351,027 | A * | 9/1994 | Kawamata et al. | 338/32 R |
| 5,506,494 | A * | 4/1996 | Ito et al. | 323/280 |
| 6,373,266 | B1 * | 4/2002 | Carelli et al. | 324/716 |
| 7,042,690 | B2 * | 5/2006 | Male | 361/62 |
| 8,009,011 | B2 * | 8/2011 | Molin et al. | 338/195 |
| 8,242,876 | B2 * | 8/2012 | Le Neel et al. | 338/25 |
| 8,531,264 | B2 * | 9/2013 | Li et al. | 338/333 |
| 2007/0075398 | A1 * | 4/2007 | Male | 257/536 |
| 2010/0073122 | A1 * | 3/2010 | Le Neel et al. | 338/25 |
| 2011/0018588 | A1 * | 1/2011 | Notman et al. | 327/87 |
| 2011/0063072 | A1 * | 3/2011 | Lo et al. | 338/314 |

* cited by examiner

*Primary Examiner* — Kyung Lee

(74) *Attorney, Agent, or Firm* — Lowe Hauptman & Ham, LLP

(57) ABSTRACT

This disclosure relates to a semiconductor device including resistor arrangement including a first resistor electrically connected to a ground voltage and a second resistor in direct physical contact with the first resistor. The second resistor is configured to receive a temperature independent current and the second resistor has thermal properties similar to those of the first resistor. This disclosure also relates to a semiconductor device including a load configured to receive an operating voltage and a voltage source configured to supply the operating voltage. The semiconductor device further includes a resistor arrangement between the load and the voltage source. This disclosure also relates to a method of using a resistor arrangement to calculate an operating current.

20 Claims, 2 Drawing Sheets

RESISTOR ARRANGEMENT AND METHOD OF USE

CROSS-REFERENCE TO RELATED APPLICATION

The present application claims priority of U.S. Provisional Patent Application Ser. No. 61/649,119, filed on May 18, 2012, which is incorporated herein by reference in its entirety.

BACKGROUND

To avoid damage to an electronic device, a power management integrated circuit (PMIC) is used to regulate an operating voltage and to monitor an operating current supplied to the electronic device. By monitoring the operating current, both the PMIC and the electronic device is able to be protected from damage resulting from sudden increases in operating currents, such as those associated with an open or short circuit. Additionally, in PMICs which operate using multiple phases to manage power supply, accurate monitoring of the operating current increases efficiency by activating only those phases necessary to supply a requisite operating current.

In a conventional arrangement, a voltage drop across a single resistor is measured to determine the operating current. However, as the temperature of the resistor changes due to heating during normal operation, the resistance of the resistor changes thereby affecting the measurement of the actual operating current. The change in resistance results in a change in the voltage drop, which in turn changes the measurement of the actual operating current.

DESCRIPTION OF THE DRAWINGS

One or more embodiments are illustrated by way of example, and not by limitation, in the figures of the accompanying drawings, wherein elements having the same reference numeral designations represent like elements throughout. It is emphasized that, in accordance with standard practice in the industry various features may not be drawn to scale and are used for illustration purposes only. In fact, the dimensions of the various features in the drawings may be arbitrarily increased or reduced for clarity of discussion.

DETAILED DESCRIPTION

The following disclosure provides many different embodiments, or examples, for implementing different features of the invention. Specific examples of components and arrangements are described below to simplify the present disclosure. These are examples and are not intended to be limiting.

Figure 1:
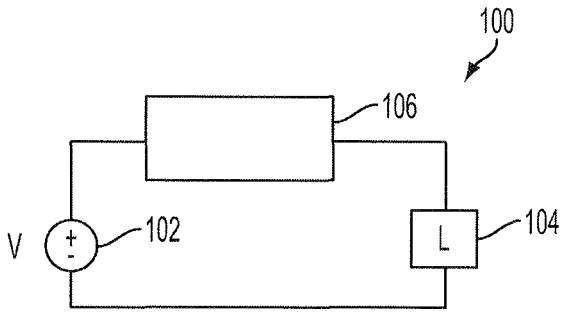
FIG. 1 is a high-level schematic diagram of an electronic device according to one or more embodiments.

FIG. 1 is a high-level schematic diagram of an electronic device 100. Electronic device 100 includes a voltage source 102 configured to supply power to a load 104. A resistor arrangement 106 is serially connected to load 104 between voltage source 102 and the load.

Voltage source 102 supplies an operating voltage to the load, so that load 104 can perform a designated function. In some embodiments, the operating voltage ranges from about 1.0 Volts to about 1.5 V.

An operating current supplied to load 104 is calculated by measuring a voltage drop across resistor arrangement 106. Accurate measurement of the operating current reduces a risk of damage to Voltage source 102 and load 104. In some embodiments, resistor arrangement 106 is part of a power management integrated circuit (PMIC).

Accurate measurement of the operating current increases efficiency of operation for power management integrated circuits (PMICs) and helps to ensure adequate power supplied to load 104. In some embodiments, the PMIC is a system-on-chip (SoC) device. In some embodiments, the PMIC includes an adjustable Pulse Width Modulated (PWM) output signal which is fed into an inductor and capacitive (LC) filter to provide a regulated voltage to load 104. By altering the PWM signal, the voltage supplied to load 104 can be controlled, thereby the PMIC is capable of preventing damage to the load due to power surges. Altering the power supplied to load 104 also helps insure the load receives sufficient power to function properly. An accurate measurement of the operating current facilitates the ability of the PMIC to accurately adjust the adjustable resistor to supply a proper power to load 104.

In some embodiments, PMICs include multiphase power supplies with each phase providing a predefined current. In a multiphase PMIC where the predefined current is 1 Ampere (A) for each phase, if the operating current is actually 2.9 A, but is incorrectly calculated to be 3.1 A, an additional phase will be activated increasing power consumption by the PMIC and reducing efficiency. In an alternative example, if the operating current is actually 3.1 A, but is incorrectly calculated to be 2.9 A, only three phases of the PMIC will be active and load 104 will not receive the requisite amount of power to function properly.

Figure 2:
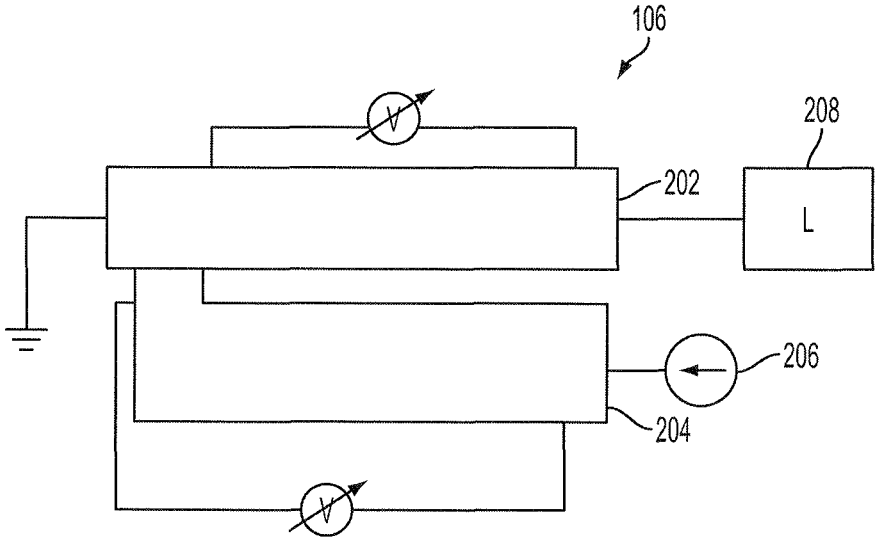
FIG. 2 is a schematic diagram of a resistor arrangement according to one or more embodiments.

FIG. 2 is a schematic diagram of resistor arrangement 106. Resistor arrangement 106 includes a first resistor 202 thermally coupled to a second resistor 204. Resistor 202 is in series with the electronic load 208, and therefore during normal operation of the electronic device, the operating current of the electronic load will pass through resistor 202. (Electronic load 104 in FIG. 1 and electronic load 208 in FIG. 2 are the same) A temperature independent current 206 from a temperature independent current source is applied to second resistor 204. First resistor 202 is electrically connected to a ground voltage and between voltage source 102 and load 104.

The thermal coupling between first resistor 202 and second resistor 204 causes the two resistors to have substantially the same temperature. In some embodiments, first resistor 202 is in direct physical contact with second resistor 204.

First resistor 202 and second resistor 204 each are comprised of a metal material. The metal material used to form first resistor 202 has similar thermal properties as the metal material used to form second resistor 204. In some embodiments, first resistor 202 and second resistor 204 are formed from the same metal material. In some embodiments, first resistor 202 and second resistor 204 comprise copper. In some embodiments, first resistor 202 and second resistor 204 comprise aluminum or another suitable conductive material.

A resistance of first resistor 202 is determined by measuring a voltage drop across first resistor 202 using a known current at a known temperature. In some embodiments, the know current is about 1 A. In some embodiments, the known current is different than 1 A. In some embodiments, the known temperature is about 298 K. In some embodiments, the known temperature is greater or less than 298 Kelvin (K). In some embodiments, the resistance of first resistor 202 ranges from about 3 mΩ to about 30 mΩ.

A resistance of second resistor 204 is determined by measuring a voltage drop across second resistor 204 using temperature independent current 206 from the temperature independent current source at the known temperature. In some embodiments, the resistance of second resistor 204 ranges from about 0.05Ω to about 5Ω. In some embodiments, temperature independent current 206 supplied by the temperature independent current source ranges from about 5 mA to about 50 mA. In some embodiments, temperature independent current 206 from the temperature independent current source is generated using at least one current mirror or bandgap circuit. In some embodiments, the resistance of resistor 204 is measured periodically, by enabling and disabling the temperature independent current 206 from the temperature independent current source. In some embodiments, the resistance is measured every 500 milliseconds (ms).

Figure 3:
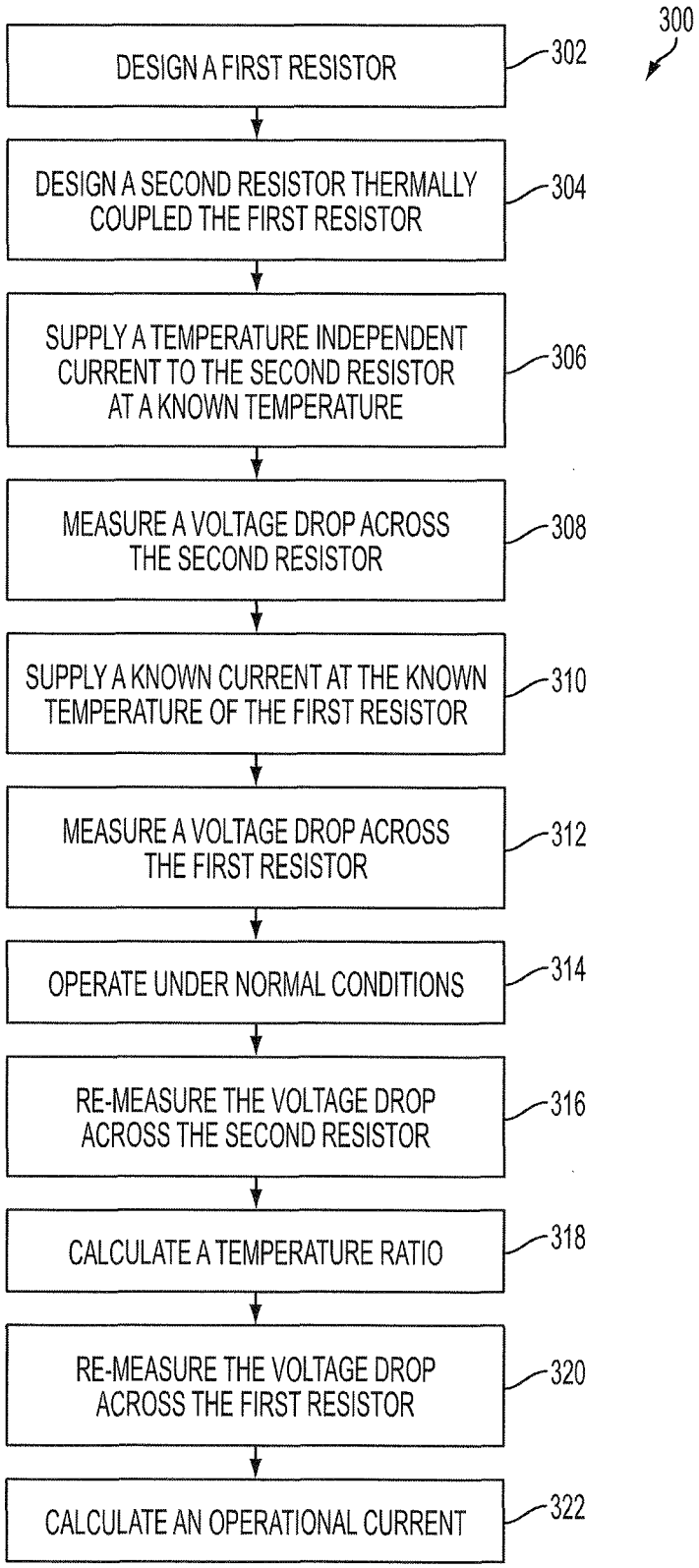
FIG. 3 is a flowchart for a method of determining an operating current according to one or more embodiments.

FIG. 3 is a flowchart of a method 300 of determining an operating current. In operation 302, a first resistor is designed. In some embodiments, the first resistor comprises copper. In some embodiments, the first resistor is designed to have a resistance ranging from about 3 mΩ to about 30 mΩ.

In operation 304, a second resistor is designed and thermally coupled to the first resistor. The second resistor has similar thermal properties to the first resistor. In some embodiments, the second resistor comprises copper. In some embodiments, the second resistor is in direct physical contact with the first resistor. In some embodiments, the second resistor has a resistance ranging from about 0.05Ω to 5 Ω.

In operation 306, a temperature independent current is applied to the second resistor at a known temperature. In some embodiments, the temperature independent current is generated using at least one current mirror or bandgap circuit. In some embodiments, the temperature independent current ranges from about 5 mA to about 50 mA. In some embodiments, the known temperature is about 298 K. In some embodiments, the known temperature is greater than or less than about 298 K. In some embodiments, operation 306 is performed periodically. In some embodiments, operation 306 occurs every 500 ms.

In operation 308, a voltage drop across the second resistor is measured. In some embodiments, the voltage drop is measured using an external probe. In some embodiments, the voltage drop is measured using an internal sensor. By measuring the voltage drop across the second resistor using the temperature independent current at the known temperature, an initial resistance value of the second resistor is determined. The initial resistance of the second resistor is later used to calculate a temperature ratio of the material of the second resistor.

In operation 310, a known current is supplied to the first resistor at the known temperature. In some embodiments, the known current is about 1 A. In some embodiments, the known current is more or less than about 1 A.

In operation 312, a voltage drop across the first resistor is measured. By measuring the voltage drop across the first resistor using the known current at the known temperature, an initial resistance value of the first resistor is determined. The initial resistance value of the first resistor is later used to calculate an operating current.

In operation 314, the electronic device and resistor arrangement 106 is operated under normal conditions. By operating the electronic load 104 under normal operating conditions, the electronic device will generate heat, which will be thermally coupled to resistor arrangement 106. In addition, by operating resistor arrangement 106 under normal conditions, the first resistor 202 and the second resistor 204 each generate heat due to electrical resistance. The heat causes a temperature of the first and second resistors to rise to an operating temperature. In some embodiments, the operating temperature differs from the known temperature. If the operating temperature is different than the known temperature, the initial resistance value of the first resistor will be different than an operating resistance value of the first resistor. A value for the operating resistance is used to accurately calculate the operating current.

In operation 316, the voltage drop across the second resistor is re-measured at the operating temperature. The temperature independent current remains constant as the temperature of the resistor arrangement changes. In some embodiments, a change in the resistance of the second resistor from the initial resistance value is due to a relationship between resistance of the material of the second resistor and temperature.

In operation 318, the temperature ratio is calculated. The temperature ratio is calculated by dividing the voltage drop across the second resistor at the operating temperature by the voltage drop across the second resistor at the known temperature.

In operation 320, the voltage drop across the first resistor is re-measured at the operating temperature.

In operation 322, an operating current is calculated. The operating current is calculated by dividing the voltage drop across the first resistor at the operating temperature by a product of the initial resistance of the first resistor and the temperature ratio. The temperature ratio accounts for first order and higher order effects on resistance within the material of the first resistor resulting from the temperature change from the known temperature to the operating temperature. The temperature ratio accounts for the first order and higher order variations because the second resistor is formed of a material with similar thermal properties as the first resistor. By monitoring the operating current calculated in this manner, resistor arrangement 106 provides an accurate value for the operating current over a wide range of temperatures.

Using the above described arrangement and method, the operating current supplied to a load is accurately calculated. By accurately calculating the operating current, PMIC efficiency is increased and a risk of damage to the load is decreased.

One aspect of this disclosure relates to a resistor arrangement which includes a first resistor electrically connected to a ground voltage and a second resistor in direct physical contact with the first resistor. The second resistor is configured to receive a temperature independent current and the second resistor has thermal properties similar to those of the first resistor.

Another aspect of this disclosure relates to a method of using a resistor arrangement, the method includes supplying a known current to a first resistor. The method further includes measuring a voltage drop across the first resistor using the known current at a known temperature to obtain an initial resistance of the first resistor. The method further includes supplying a temperature independent current to a second resistor. The method further includes measuring a voltage drop across the second resistor using the temperature independent current at a known temperature. The method further includes supplying an operating voltage to the first resistor to heat the first and second resistors to an operating temperature. The method further includes re-measuring a voltage drop across the second resistor using the temperature independent current at the operating temperature and calculating a temperature ratio using the voltage drop across the second resistor at the known temperature and the voltage drop across the second resistor at the operating temperature. The method further includes re-measuring a voltage drop across the first resistor at the operating temperature and calculating an operating current using the temperature ratio, initial resistance of the first resistor and the voltage drop across the first resistor at the operating temperature.

Another aspect of the present disclosure relates to a semiconductor device including a load configured to receive an operating voltage and a voltage source configured to supply the operating voltage. The semiconductor device further includes a resistor arrangement between the load and the voltage source. The resistor arrangement includes a first resistor electrically connected in series to the load and to a ground voltage. The resistor arrangement further includes a second resistor thermally coupled to the first resistor. The second resistor is configured to receive a temperature independent current, and the second resistor has thermal properties similar to those of the first resistor.

It will be readily seen by one of ordinary skill in the art that the disclosed embodiments fulfill one or more of the advantages set forth above. After reading the foregoing specification, one of ordinary skill will be able to affect various changes, substitutions of equivalents and various other embodiments as broadly disclosed herein. It is therefore intended that the protection granted hereon be limited only by the definition contained in the appended claims and equivalents thereof.

What is claimed is:

1. A semiconductor device comprising:

a resistor arrangement comprising:

a first resistor electrically connected to a ground voltage; and a second resistor in direct physical contact with the first resistor, the second resistor configured to receive a temperature independent current, and the second resistor has thermal properties similar to those of the first resistor.

2. The semiconductor device of claim 1, wherein the first resistor and the second resistor comprise copper.

3. The semiconductor device of claim 1, further comprising:

a load configured to receive an operating voltage, wherein the first resistor is electrically connected in series to the load; and a voltage source configured to supply the operating voltage.

4. The semiconductor device of claim 3, wherein the operating voltage ranges from about 1V to about 5V.

5. The semiconductor device of claim 1, wherein the temperature independent current ranges from about 5 mA to about 50 mA.

6. The semiconductor device of claim 1, wherein a resistance of the second resistor ranges from about 0.05Ω to about 5Ω.

7. The semiconductor device of claim 1, wherein a resistance of the first resistor ranges from about 3 mΩ to about 30 mΩ.

8. A method of using a resistor arrangement, the method comprising:

supplying a known current to a first resistor, wherein the first resistor is electrically connected to a ground voltage;

measuring a voltage drop across the first resistor using the known current at a known temperature to obtain an initial resistance of the first resistor;

supplying a temperature independent current to a second resistor;

measuring a voltage drop across the second resistor using the temperature independent current at the known temperature;

supplying an operating voltage to the first resistor to heat the first resistor and the second resistor to an operating temperature;

measuring the voltage drop across the second resistor using the temperature independent current at the operating temperature;

determining a temperature ratio based on the voltage drop across the second resistor at the known temperature and the voltage drop across the second resistor at the operating temperature;

measuring the voltage drop across the first resistor at the operating temperature;

determining the operating current using the temperature ratio, initial resistance of the first resistor and the voltage drop across the first resistor at the operating temperature; and adjusting a power supply to a load based on the determined operating current.

9. The method of claim 8, wherein measuring the voltage drop across the second resistor at the known temperature comprises measuring the voltage drop across the second resistor comprising the same material as the first resistor.

10. The method of claim 9, wherein measuring the voltage drop across the second resistor at the known temperature comprises measuring the voltage drop across the second resistor comprising copper.

11. The method of claim 8, wherein supplying the operating voltage comprises supplying an operating voltage ranging from about 10 mV to about 100 mV.

12. The method of claim 8, wherein supplying the temperature independent current comprises supplying a current ranging from about 5 mA to about 50 mA.

13. The method of claim 8, wherein measuring the voltage drop across the second resistor comprise measuring a resistance ranging from about 0.05Ω to about 5Ω.

14. The method of claim 8, wherein measuring the voltage drop across the first resistor comprises measuring a resistance ranging from about 3 mΩ to about 30 mΩ.

15. A semiconductor device comprising:

a load configured to receive an operating voltage;

a voltage source configured to supply the operating voltage; and a resistor arrangement between the load and the voltage source, the resistor arrangement comprising:

a first resistor electrically connected to a ground voltage and serially connected to the load; and a second resistor in direct physical contact with the first resistor, the second resistor configured to receive a temperature independent current, and the second resistor having thermal properties similar to those of the first resistor.

16. The semiconductor device of claim 15, wherein the first resistor and the second resistor comprise copper.

17. The semiconductor device of claim 15, wherein the operating voltage ranges from about 10 mV to about 100 mV.

18. The semiconductor device of claim 15, wherein the temperature independent current ranges from about 5 mA to about 50 mA.

19. The semiconductor device of claim 15, wherein a resistance of the second resistor ranges from about 0.05Ω to about 5Ω.

20. The semiconductor device of claim 15, wherein a resistance of the first resistor ranges from about 3 mΩ to about 30 mΩ.

* * * * *